US006800322B2

(12) United States Patent
Takeishi et al.

(10) Patent No.: US 6,800,322 B2
(45) Date of Patent: Oct. 5, 2004

(54) METHOD OF MAKING A COMPOSITE SUBSTRATE

(75) Inventors: Taku Takeishi, Chuo-ku (JP); Katsuto Nagano, Chuo-ku (JP); Jun Hagiwara, Chuo-ku (JP); Suguru Takayama, Chuo-ku (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/971,699

(22) Filed: Oct. 9, 2001

(65) Prior Publication Data

US 2002/0098368 A1 Jul. 25, 2002

Related U.S. Application Data

(63) Continuation of application No. PCT/JP01/00814, filed on Feb. 6, 2001.

(30) Foreign Application Priority Data

Feb. 7, 2000 (JP) ..... 2000-029465
Mar. 3, 2000 (JP) ..... 2000-059521
Mar. 3, 2000 (JP) ..... 2000-059522

(51) Int. Cl.[7] ..... B05D 5/12

(52) U.S. Cl. ..... 427/64; 427/66; 427/126.3; 427/226

(58) Field of Search ..... 427/64, 66, 126.3, 427/226

(56) References Cited

U.S. PATENT DOCUMENTS 4,757,235 A * 7/1988 Nunomura et al. ..... 313/509
5,264,714 A * 11/1993 Nakaya et al. ..... 257/78

FOREIGN PATENT DOCUMENTS

| | | | |
|---|---|---|---|
| JP | 61-230296 | | 10/1986 |
| JP | 62-278791 | | 12/1987 |
| JP | 62-278792 | | 12/1987 |
| JP | 62-281295 | | 12/1987 |
| JP | 63-69193 | | 3/1988 |
| JP | 64-63297 | | 3/1989 |
| JP | 61791 | * | 2/1992 |
| JP | 4-61791 | | 2/1992 |
| JP | 5-121169 | | 5/1993 |
| JP | 6-267656 | | 9/1994 |
| JP | 50197 | * | 2/1995 |
| JP | 7-50197 | | 2/1995 |
| JP | 8-83686 | | 3/1996 |

OTHER PUBLICATIONS

R. Kurchania, et al., Journal of Materials Science, Iss. 33, pp. 659–666, "Sythesis of (Pb,La) $(Zr,Ti)O_3$ Films Using a Diol Based Sol–Gel Route", 1998.

* cited by examiner

*Primary Examiner*—Brian K. Talbot
(74) *Attorney, Agent, or Firm*—Oblon, Spivak, McClelland, Maier & Neustadt, P.C.

(57) ABSTRACT

The invention aims to provide a method for preparing a composite substrate of substrate/electrode/dielectric layer structure having a thick-film dielectric layer with a smooth surface using a sol-gel solution of high concentration capable of forming a film to a substantial thickness without generating cracks, the composite substrate and an EL device using the same. The object is attained by a method for preparing a composite substrate including in order an electrically insulating substrate, an electrode and an insulator layer formed thereon by a thick film technique, wherein a thin-film insulator layer is formed on the insulator layer by applying to the insulator layer a sol-gel solution obtained by dissolving a metal compound in a diol represented by $OH(CH_2)_nOH$ as a solvent, followed by drying and firing; the composite substrate and an EL device using the same.

18 Claims, 1 Drawing Sheet

METHOD OF MAKING A COMPOSITE SUBSTRATE

CROSS-REFERENCE TO RELATED APPLICATION

This application is a continuation and claims priority to International Application No. PCT/JPO1/00814 filed Feb. 06, 2001 and Japanese Application Nos. 2000-029465 filed Feb. 07, 2000, 2000–059521 field Mar. 03, 2000 and 2000-059522 filed Mar. 03, 2000, and the entire content of both application is hereby incorporated by reference.

BACKGROUND OF THE INVENTION

1. Field of the Invention

This invention relates to a composite substrate having a dielectric and an electrode, an electroluminescent (EL) device using the same, and a method for preparing the same.

2. Background Art

The phenomenon that a material emits light upon application of an electric field is known as electroluminescence (EL). Devices utilizing this phenomenon are on commercial use as backlight in liquid crystal displays (LCD) and watches.

The EL devices include dispersion type devices of the structure that a dispersion of a powder phosphor in an organic material or enamel is sandwiched between electrodes, and thin-film type devices in which a thin-film phosphor sandwiched between two electrodes and two insulating thin films is formed on an electrically insulating substrate. For each type, the drive modes include DC voltage drive mode and AC voltage drive mode. The dispersion type EL devices are known from the past and have the advantage of easy manufacture, but their use is limited because of a low luminance and a short lifetime. On the other hand, the thin-film type EL devices have markedly spread the practical range of EL device application by virtue of a high luminance and a long lifetime.

In prior art thin-film type EL devices, the predominant structure is such that blue sheet glass customarily used in liquid crystal displays and plasma display panels (PDP) is employed as the substrate, a transparent electrode of ITO or the like is used as the electrode in contact with the substrate, and the phosphor emits light which exits from the substrate side. Among phosphor materials, Mn-doped ZnS which emits yellowish orange light has been often used from the standpoints of ease of deposition and light emitting characteristics. The use of phosphor materials which emit light in the primaries of red, green and blue is essential to manufacture color displays. Engineers continued research on candidate phosphor materials such as Ce-doped SrS and Tm-doped ZnS for blue light emission, Sm-doped ZnS and Eu-doped CaS for red light emission, and Tb-doped ZnS and Ce-doped CaS for green light emission. However, problems of emission luminance, luminous efficiency and color purity remain outstanding until now, and none of these materials have reached the practical level.

High-temperature film deposition and high-temperature heat treatment following deposition are known to be promising as means for solving these problems. When such a process is employed, use of blue sheet glass as the substrate is unacceptable from the standpoint of heat resistance. Quartz substrates having heat resistance are under consideration, but not adequate in such applications requiring a large surface area as in displays because the quartz substrates are very expensive.

It was recently reported that a device was developed using an electrically insulating ceramic substrate as the substrate and a thick-film dielectric instead of a thin-film insulator under the phosphor, as disclosed in JP-A 7-50197 and JP-B 7-44072.

FIG. 2 illustrates the basic structure of this device. The EL device in FIG. 2 is structured such that a lower electrode 12, a thick-film dielectric layer 13, a light emitting layer 14, a thin-film insulating layer 15 and an upper electrode 16 are successively formed on a substrate 11 of ceramic or similar material. Since the light emitted by the phosphor exits from the upper side of the EL structure opposite to the substrate as opposed to the prior art structure, the upper electrode is a transparent electrode.

In this device, the thick-film dielectric has a thickness of several tens of microns which is about several hundred to several thousand times the thickness of the thin-film insulator. This offers advantages including a minimized chance of breakdown caused by pinholes or the like, high reliability, and high manufacturing yields.

Use of the thick dielectric invites a drop of the voltage applied to the phosphor layer, which is overcome by using a high-permittivity material as the dielectric layer. Use of the ceramic substrate and the thick-film dielectric permits a higher temperature for heat treatment. As a result, it becomes possible to deposit a light emitting material having good luminescent characteristics, which was impossible in the prior art because of the presence of crystal defects.

However, the light emitting layer formed on the thick-film dielectric layer has a thickness of several hundreds of nanometers which is about one hundredth of the thickness of the thick-film dielectric layer. This requires the surface of the thick-film dielectric layer to be smooth at a level below the thickness of the light emitting layer. However, a conventional thick-film technique was difficult to form a dielectric layer having a fully flat and smooth surface.

If the surface of the dielectric layer is not flat or smooth, there is a risk that a light emitting layer cannot be evenly formed thereon or a delamination phenomenon can occur between the light emitting layer and the dielectric layer, substantially detracting from display quality. Therefore, the prior art method needed the steps of removing large asperities as by polishing and removing small asperities by a sol-gel process.

In the sol-gel process taken for the surface smoothing purpose, however, if a sol-gel solution which is customarily used in forming dielectric thin films is employed, the thickness of a film formed by a single coating step must be restricted to a certain level in order to prevent crack generation. Then a number of coating steps must be carried out in order to provide the thick-film dielectric layer with a fully smooth surface.

SUMMARY OF THE INVENTION

An object of the invention is to provide a method for preparing a composite substrate of substrate/electrode/dielectric layer structure having a thick-film dielectric layer with a smooth surface using a sol-gel solution of high concentration capable of forming a film to a substantial thickness without generating cracks, the composite substrate and an EL device using the same.

The above object is attained by the present invention as constructed below.

(1) A method for preparing a composite substrate including in order an electrically insulating substrate, an electrode and an insulator layer formed on the substrate by a thick film technique, wherein a thin-film insulator layer is formed on the insulator layer by applying to the insulator layer a sol-gel solution obtained by dissolving a metal compound in a diol represented by $OH(CH_2)_nOH$ as a solvent, followed by drying and firing.

(2) The method for preparing a composite substrate according to (1) wherein the solvent is propane diol $OH(CH_2)_3OH$.

(3) The method for preparing a composite substrate according to (1) or (2) wherein at least one of the metal compound is an acetylacetonato complex $M(CH_3COCHCOCH_3)_n$ wherein M is a metal element, or an acetylacetonato product obtained by reacting a metal compound with acetylacetone $CH_3COCH_2COCH_3$.

(4) The method for preparing a composite substrate according to any one of (1) to (3) wherein the metal compound is $(Pb_xL_{1-x})(Zr_y,Ti_{1-y})O_3$ wherein x and y each are from 0 to 1.

(5) The method for preparing a composite substrate according to any one of (1) to (4) wherein the drying temperature of the sol-gel solution is at least 350° C.

(6) A composite substrate obtained by the method of any one of (1) to (5).

(7) The composite substrate of (6) wherein a functional thin film is to be formed on the insulator layer.

(8) An EL device comprising at least a light emitting layer and a transparent electrode on the composite substrate of (6) or (7).

(9) The EL device of (8) further comprising a thin-film insulating layer between the light emitting layer and the transparent electrode.

According to the invention, a composite substrate of substrate/electrode/dielectric layer structure having a thick-film dielectric layer with a smooth surface can be produced by applying the specific sol-gel solution to the thick-film dielectric layer, followed by drying and firing. When an EL device is fabricated using the composite substrate having a smooth surface, a light emitting layer can be evenly formed on the composite substrate without the risk of delamination or the like. As a consequence, the resulting EL device has improved luminescent characteristics and reliability.

BEST MODE FOR CARRYING OUT THE INVENTION

The invention is a method for preparing a composite substrate and more particularly, a method for preparing a composite substrate including in order an electrically insulating substrate, an electrode and an insulator layer formed on the substrate by a thick film technique, wherein a thin-film insulator layer is formed on the insulator layer by applying to the insulator layer a sol-gel solution obtained by dissolving a metal compound in a diol represented by $OH(CH_2)_nOH$ as a solvent, followed by drying and firing.

By using a diol $OH(CH_2)_nOH$ as the solvent of a sol-gel solution and dissolving the metal compound therein, a coating with a substantial thickness is obtainable. Thus, the insulating layer of the composite substrate can be readily smoothed.

Figure 1:
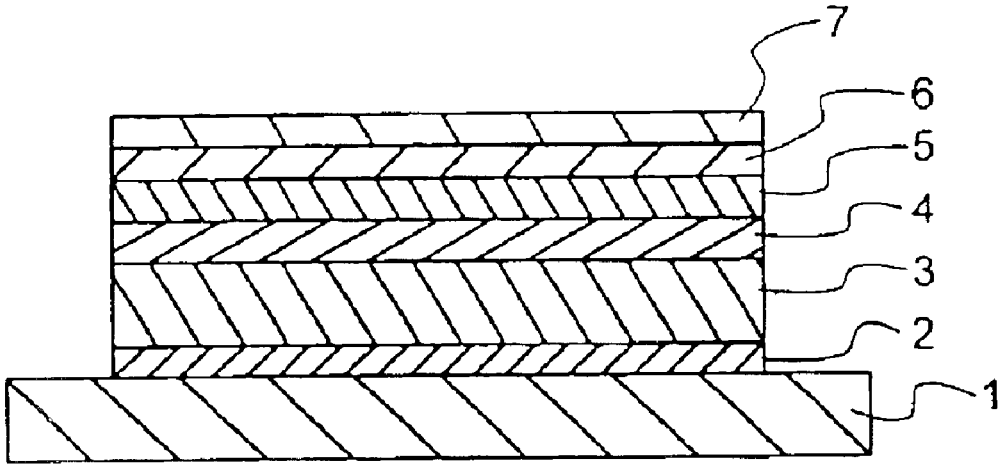
FIG. 1 is a fragmentary cross-sectional view showing the construction of a thin-film EL device according to the invention.
Figure 2:
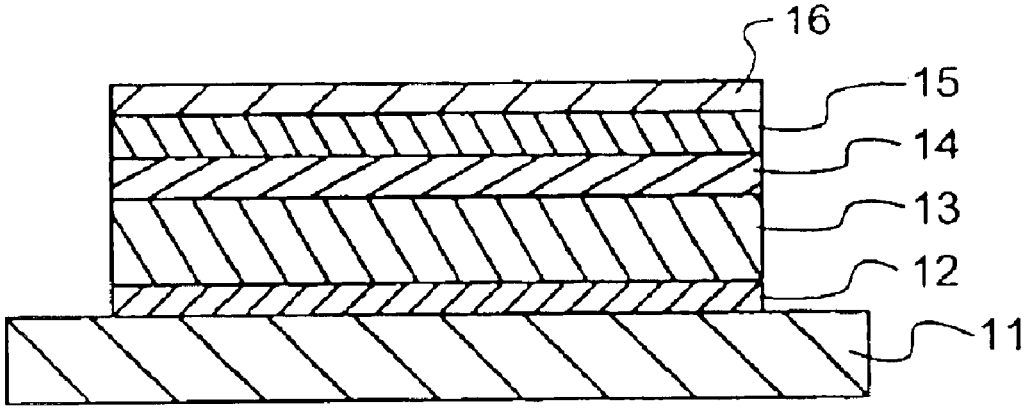
FIG. 2 PRIOR ART
FIG. 2 is a fragmentary cross-sectional view showing the construction of a prior art thin-film EL device.

Described below is the illustrative construction of the present invention. FIG. 1 is a cross-sectional view of an electroluminescent (EL) device using a composite substrate having an electrode and an insulator layer according to the invention.

The composite substrate is a ceramic laminate structure having an electrically insulating ceramic substrate 1, a thick-film electrode 2 formed thereon in a predetermined pattern, an insulator layer 3 formed thereon by a thick-film technique, and a thin-film insulator layer 4 formed by a sol-gel process.

The EL device using the composite substrate has a basic structure including a thin-film light emitting layer 5, an upper thin-film insulator layer 6, and an upper transparent electrode 7, which are formed on the composite substrate by such a technique as vacuum evaporation, sputtering or CVD. A single insulating structure with the upper thin-film insulator layer omitted is also acceptable.

The composite substrate of the invention is characterized by a smooth surface owing to the thin-film insulator layer being formed using a sol-gel solution in a diol solvent.

The high concentration sol-gel solution used in forming the thin-film insulator layer is prepared by dissolving a metal compound in a diol $OH(CH_2)_nOH$ such as propane diol as the solvent. Although metal alkoxides are often used as the metal compound source in the preparation of sol-gel solutions, they are prone to hydrolysis. In preparing a high concentration solution, it is preferred to use acetylacetonato compounds and derivatives thereof in order to prevent the source from precipitating and settling and the solution from solidifying.

The preferred solvent is propane diol $OH(CH_2)_3OH$. It is also preferred that at least one of the metal compounds be an acetylacetonato complex $M(CH_3COCHCOCH_3)_n$ wherein M is a metal element, or an acetylacetonato product obtained by reacting a metal compound with acetylacetone $CH_3COCH_2COCH_3$. The metal element represented by M is selected from Ba, Ti, Zr, Mg, etc.

The metal compound to be dissolved in the sol-gel solution may be any of metal compounds used in well-known sol-gel solutions. Illustrative metal compounds include $(Pb_xLa_{1-x})(Zr_y, Ti_{1-y})O_3$ wherein x and y each are from 0 to 1, $BaTiO_3$, $Pb(Mg_{1/3}Nb_{2/3})O_3$, and $Pb(Fe_{2/3}W_{1/3})O_3$. Of these, $(Pb_xLa_{1-x})(Zr_y,Ti_{1-y})O_3$ wherein x and y each are from 0 to 1 is most preferred. Preferably the metal compound is present at a level of 0.1 to 5.0 mol, and especially 0.5 to 1.0 mol in 1000 ml of the solvent.

The sol-gel solution thus prepared is applied onto the insulator layer, preferably by spin coating or dip coating. The composite substrate coated with the sol-gel solution is then dried and fired. To prevent cracks from generating on the surface of the thin-film insulator layer formed by the sol-gel process, the drying step should preferably be carried out at or above 350° C., and more preferably at or above 400° C.

To obtain a smooth thin-film insulator layer surface, the procedure consisting of sol-gel solution application, drying and firing steps is repeated several times, preferably two to five times. Alternatively, the solution application and drying steps are repeated prior to firing. In a still alternative procedure, the sol-gel solution is applied to the composite substrate which has not been fired, and the electrode, thick-film dielectric layer and thin-film insulator layer are co-fired.

The preferred drying conditions include a time of about 1 to 10 minutes at a temperature of at least 400° C. The preferred firing conditions include a time of about 5 to 30 minutes at a temperature of 500 to 900° C.

The composite substrate precursor can be prepared by conventional thick film techniques. Specifically, on an electrically insulating ceramic substrate of $Al_2O_3$ or crystallized glass, an electrode paste prepared by mixing a conductor powder such as Pd or Ag/Pd with a binder and a solvent is printed in a predetermined pattern by a screen printing technique or the like. Then, an insulator paste prepared by mixing a powdery insulating material with a binder and a solvent is similarly printed on the electrode pattern. Alternatively, the insulator paste is cast to form a green sheet, which is laid on the electrode. In a still alternative embodiment, an electrode is printed on a green sheet of insulator, which is laid on the substrate.

The thus obtained composite green body is fired at a temperature appropriate for the electrode and dielectric layer. When a noble metal such as Pd, Pt, Au or Ag or an alloy thereof is used as the electrode, firing in air is possible. When a dielectric material which has been tailored to be resistant to chemical reduction is used so that firing in a reducing atmosphere is possible, a base metal such as Ni or an alloy thereof may be used as the internal electrode. The electrode usually has a thickness of 2 to 3 $\mu$m. The dielectric layer should also have a thickness of 2 to 3 $\mu$m or more from the manufacturing standpoint. A thickness of up to 300 $\mu$m is preferred because too thick a dielectric layer can have a reduced capacitance so that only a reduced voltage may be applied across the light emitting layer, cause image blur owing to spreading of an internal electric field when a display is constructed therefrom, and permit cross-talks to occur.

The substrate used herein is not critical as long as it is electrically insulating, does not contaminate any overlying layers such as an insulating layer (dielectric layer) and electrode layer, and maintains a desired strength. Illustrative materials are ceramic substrates including alumina ($Al_2O_3$), quartz glass ($SiO_2$), magnesia (MgO), forsterite ($2MgO \cdot SiO_2$), steatite ($MgO \cdot SiO_2$), mullite ($3Al_2O_3 \cdot 2SiO_2$), beryllia (BeO), zirconia ($ZrO_2$), aluminum nitride (AlN), silicon nitride (SiN), and silicon carbide (SiC+BeO). Additionally, barium, strontium and lead family perovskite compounds are useful, and in this case, a substrate material having the same composition as the insulating layer can be used. Of these, alumina substrates are preferred; and beryllia, aluminum nitride and silicon carbide are preferred when heat conductivity is necessary. Use of a substrate material having the same composition as the insulating layer is advantageous because bowing, stripping and other undesired phenomena due to differential thermal expansion do not occur.

The temperature at which these substrates are fired is at least about 800° C., preferably about 800° C. to 1,500° C., and more preferably about 1,200° C. to 1,400° C.

A glass material may be contained in the substrate for the purpose of lowering the firing temperature. Illustrative are PbO, $B_2O_3$, SiO2, CaO, MgO, $TiO_2$, and $ZrO_2$, alone or in admixture of any. The content of glass is about 20 to 30% by weight based on the substrate material.

An organic binder may be used when a paste for forming the substrate is prepared. The organic binder used herein is not critical and a proper choice may be made among binders commonly used for ceramic materials. Examples of the organic binder include ethyl cellulose, acrylic resins and butyral resins, and examples of the solvent include $\alpha$-terpineol, butyl Carbitol, and kerosene. The contents of organic binder and solvent in the paste are not critical and may be as usual. For example, the content of organic binder is about 1 to 5 wt % and the content of solvent is about 10 to 50 wt %.

In the substrate-forming paste, various additives such as dispersants, plasticizers, and insulators are contained if necessary. The overall content of these additives should preferably be no more than 1 wt %.

The substrate generally has a thickness of about 1 to 5 mm, and preferably about 1 to 3 mm.

A base metal may be used as the electrode material when firing is carried out in a reducing atmosphere. Preferably, use is made of one or more of Mn, Fe, Co, Ni, Cu, Si, W and Mo, as well as Ni-Cu, Ni-Mn, Ni-Cr, Ni-Co and Ni-Al alloys, with Ni, Cu and Ni-Cu alloy being more preferred.

When firing is carried out in an oxidizing atmosphere, a metal which does not form an oxide in an oxidizing atmosphere is preferred. Illustrative examples include one or more of Ag, Au, Pt, Rh, Ru, Ir, Pb and Pd, with Ag, Pd and Ag-Pd alloy being more preferred.

The electrode layer may contain glass frit because its adhesion to the underlying substrate is enhanced. When firing is carried out in a neutral or reducing atmosphere, a glass frit which does not lose glass behavior in such an atmosphere is preferred.

The composition of glass frit is not critical as long as the above requirement is met. For example, there may be used one or more glass frits selected from among silicate glass ($SiO_2$ 20–80 wt %, $Na_2O$ 80–20 wt %), borosilicate glass ($B_2O_3$ 5–50 wt %, $SiO_2$ 5–70 wt %, PbO 1–10 wt %, $K_2O$ 1–15 wt %), and aluminosilicate glass ($Al_2O_3$ 1–30 wt %, $SiO_2$ 10–60 wt %, $Na_2O$ 5–15 wt %, CaO 1–20 wt %, $B_2O_3$ 5–30 wt %). If desired, at least one additive selected from among CaO 0.01–50 wt %, SrO 0.01–70 wt %, BaO 0.01–50 wt %, MgO 0.01–5 wt %, ZnO 0.01–70 wt %, PbO 0.01–5 wt %, $Na_2O$ 0.01–10 wt %, $K_2O$ 0.01–10 wt % and $MnO_2$ 0.01–20 wt % may be admixed with the glass frit so as to give a predetermined compositional ratio. The content of glass relative to the metal component is not critical although it is usually about 0.5 to 20% by weight, and preferably about 1 to 10% by weight. The overall content of the additives in the glass component is preferably no more than 50% by weight provided that the glass component is 100.

An organic binder may be used when a paste for forming the electrode layer is prepared. The organic binder used herein is the same as described for the substrate. In the electrode layer-forming paste, various additives such as dispersants, plasticizers, and insulators are contained if necessary. The overall content of these additives should preferably be no more than 1 wt %.

The electrode layer generally has a thickness of about 0.5 to 5 $\mu$m, and preferably about 1 to 3 $\mu$m.

The insulating material of which the insulator layer is made is not critical and a choice may be made among a variety of insulating materials. For example, titanium oxide-base compound oxides, titanate-base compound oxides, and mixtures thereof are preferred.

Examples of the titanium oxide-base compound oxides include titanium oxide ($TiO_2$) which optionally contains nickel oxide (NiO), copper oxide (CuO), manganese oxide ($Mn_3O_4$), alumina ($Al_2O_3$), magnesium oxide (MgO), silicon oxide ($SiO_2$), etc. in a total amount of 0.001 to 30% by weight. An exemplary titanate-base compound oxide is barium titanate ($BaTiO_3$), which may have a Ba/Ti atomic ratio between about 0.95 and about 1.20.

The titanate-base compound oxide ($BaTiO_3$) may contain one or more oxides selected from magnesium oxide (MgO), manganese oxide ($Mn_3O_4$), tungsten oxide ($WO_3$), calcium oxide (CaO), zirconium oxide ($ZrO_2$), niobium oxide ($Nb_2O_5$), cobalt oxide ($Co_3O_4$), yttrium oxide ($Y_2O_3$), and barium oxide (BaO) in a total amount of 0.001 to 30% by weight. Also, at least one oxide selected from among $SiO_2$, MO (wherein M is one or more elements selected from Mg, Ca, Sr and Ba), $Li_2O$ and $B_2O_3$ may be included as an auxiliary component for adjusting the firing temperature and coefficient of linear expansion. The insulator layer generally has a thickness of about 5 to 1,000 $\mu$m, preferably about 5 to 50 $\mu$m, and more preferably about 10 to 50 $\mu$m, though the thickness is not critical.

The insulating layer may also be formed of a dielectric material. Use of dielectric material is preferred particularly when the composite substrate is applied to thin-film EL devices. The dielectric material used is not critical and selected from a variety of dielectric materials, for example, titanium oxide-base compound oxides, titanate-base compound oxides, and mixtures thereof as described above.

The titanium oxide-base compound oxides are the same as above. Also, at least one oxide selected from among $SiO_2$, MO (wherein M is one or more elements selected from Mg, Ca, Sr and Ba), $Li_2O$ and $B_2O_3$ may be included as an auxiliary component for adjusting the firing temperature and coefficient of linear expansion.

Especially preferred dielectric materials are given below. These dielectric materials contain barium titanate as a main component and silicon oxide and at least one of magnesium oxide, manganese oxide, barium oxide and calcium oxide as auxiliary components of the dielectric layer (or insulating layer). On calculating barium titanate as $BaTiO_3$, magnesium oxide as MgO, manganese oxide as MnO, barium oxide as BaO, calcium oxide as CaO and silicon oxide as $SiO_2$, the proportions of the respective compounds in the dielectric layer are MgO: 0.1 to 3 mol, preferably 0.5 to 1.5 mol, MnO: 0.05 to 1.0 mol, preferably 0.2 to 0.4 mol, BaO+CaO: 2 to 12 mol, and $SiO_2$: 2 to 12 mol per 100 mol of $BaTiO_3$.

The ratio $(BaO+CaO)/SiO_2$ is not critical although it is preferably between 0.9 and 1.1. BaO, CaO and $SiO_2$ may be incorporated in the form of $(Ba_xCa_{1-x}O)_y \cdot SiO_2$. Herein, x and y preferably satisfy $0.3 \leqq x \leqq 0.7$ and $0.95 \leqq y < 1.05$ in order to obtain a dense sintered body. The content of $(Ba_xCa_{1-x}O)_y \cdot SiO_2$ is preferably 1 to 10% by weight, and more preferably 4 to 6% by weight based on the total weight of $BaTiO_3$, MgO and MnO. It is noted that the oxidized state of each oxide is not critical as long as the contents of metal elements constituting the respective oxides are within the above ranges.

Preferably, the dielectric layer contains up to 1 mol calculated as $Y_2O_3$ of yttrium oxide as an auxiliary component per 100 mol calculated as $BaTiO_3$ of barium titanate. The lower limit of the $Y_2O_3$ content is not critical although inclusion of at least 0.1 mol is preferred to achieve a satisfactory effect. When yttrium oxide is included, the content of $(Ba_xCa_{1-x}O)_y \cdot SiO_2$ is preferably 1 to 10% by weight, and more preferably 4 to 6% by weight based on the total weight of $BaTiO_3$, MgO, MnO and $Y_2O_3$.

The reason of limitation of the respective auxiliary components is given below.

If the content of magnesium oxide is below the range, the temperature response of capacitance does not fall within the desired range. A content of magnesium oxide above the range abruptly exacerbates sintering, resulting in insufficient consolidation, a short IR accelerated lifetime and a low relative permittivity.

If the content of manganese oxide is below the range, satisfactory reduction resistance is lost, resulting in an insufficient IR accelerated lifetime. It also becomes difficult to reduce the dielectric loss tanδ. A content of manganese oxide above the range makes it difficult to reduce the change with time of capacitance under a DC electric field applied.

If the contents of BaO+CaO, $SiO_2$ and $(Ba_xCa_{1-x}O)_y \cdot SiO_2$ are too low, the change with time of capacitance under a DC electric field applied becomes large and the IR accelerated lifetime becomes insufficient. If their contents are too high, an abrupt decline of relative permittivity appears.

Yttrium oxide is effective for improving the IR accelerated lifetime. With a content of yttrium oxide above the range, the layer may have a reduced capacitance and be insufficiently consolidated due to ineffective sintering.

Further, aluminum oxide may be contained in the dielectric layer. Aluminum oxide has the function of enabling sintering at relatively low temperatures. The content of aluminum oxide calculated as $Al_2O_3$ is preferably 1% by weight or less based on the entire dielectric material. Too high an aluminum oxide content raises a problem that sintering is rather retarded.

Preferably the dielectric layer has a thickness of up to about 100 $\mu$m, more preferably up to about 50 $\mu$m, and especially about 2 to 20 $\mu$m, per layer.

An organic binder may be used when a paste for forming the insulating layer is prepared. The organic binder used herein is the same as described for the substrate. In the insulating layer-forming paste, various additives such as dispersants, plasticizers, and insulators are contained if necessary. The overall content of these additives should preferably be no more than 1 wt %.

The sintering temperature of the substrate and the dielectric layer should preferably be higher than the sintering temperature of the thin-film dielectric layer, and especially higher than the sintering temperature of the thin-film dielectric layer plus 50° C. The upper limit is not critical although it is usually about 1,500° C.

According to the invention, the composite substrate precursor is preferably pressed to smooth its surface. The pressing means contemplated herein include a method of pressing the composite substrate using a large surface area die, and a method of placing a roll tightly against the thick-film dielectric layer of the composite substrate and rotating the roll while moving the composite substrate. The pressure applied is preferably about 10 to 500 ton/$m^2$.

Better results are obtained when a thermoplastic resin is used as the binder in preparing the electrode and/or insulator paste, and the pressing die or roll is heated upon pressure application.

In the embodiment wherein the green insulating body is pressed using the die or roll, a resin film having a parting agent applied is preferably interposed between the die or roll and the green insulating body in order to prevent the green insulating body from sticking or bonding to the die or roll.

Examples of the resin film include tetraacetyl cellulose (TAC), polyethylene terephthalate (PET), polyethylene naphthalate (PEN), syndiotactic polystyrene (SPS), polyphenylene sulfide (PPS), polycarbonate (PC), polyarylate (PAr), polysulfone (PSF), polyester sulfone (PES), polyether imide (PEI), cyclic polyolefin, and brominated phenoxy resin, with PET film being especially preferred.

The parting agent may be a silicone material such as a dimethylsilicone base material. The parting agent is usually coated onto the resin film.

When the die or roll is heated, the temperature of the die or roll, which differs depending on the type of binder, especially the melting point, glass transition temperature and other properties of thermoplastic resin, is usually about 50 to 200° C. Too low a heating temperature fails to achieve sufficient smoothing effects. If the heating temperature is too high, the binder can be partly decomposed and the green insulating body be bonded to the die or roll or the resin film.

The insulator layer of the green composite substrate thus obtained should preferably have a surface roughness Ra of up to 0.1 $\mu$m. A surface roughness of this level can be accomplished by adjusting the surface roughness of the die or simply by interposing a resin film having a smooth surface during pressure application.

The composite substrate of the invention is prepared by stacking an insulating layer precursor, electrode layer precursor and substrate precursor according to a conventional printing or sheeting technique using a paste, and firing the laminate.

Firing is preceded by binder removal which may be performed under well-known conditions. When firing is carried out in a reducing atmosphere, the following conditions are especially preferred.

Heating rate: 5–500° C./hr, especially 10–400° C./hr

Holding temperature: 200–400° C., especially 250–300° C.

Holding time: 0.5–24 hr, especially 5–20 hr

Atmosphere: air

The atmosphere for firing may be determined as appropriate, depending on the type of conductor in the electrode layer-forming paste. When firing is carried out in a reducing atmosphere, the preferred firing atmosphere is a mixture of a substantial proportion of $N_2$, 1 to 10% of $H_2$, and $H_2O$ vapor resulting from the water vapor pressure at 10 to 35° C. The oxygen partial pressure is preferably in the range of $10^{-8}$ to $10^{-12}$ atm. If the oxygen partial pressure is below the range, the conductor in the electrode layer can be abnormally sintered and disconnected. An oxygen partial pressure in excess of the range tends to oxidize the electrode layer. In the event of firing in an oxidizing atmosphere, conventional firing in air may be carried out.

The holding temperature during the firing step may be determined as appropriate, depending on the type of the insulator layer, although it is usually about 800 to 1,400° C. A holding temperature below the range may result in insufficient consolidation whereas a holding temperature above the range may often cause the electrode layer to be disconnected. The temperature holding time during the firing is preferably 0.05 to 8 hours, and especially 0.1 to 3 hours.

When fired in a reducing atmosphere, the composite substrate is preferably annealed if necessary. The annealing serves to oxidize the insulator layer again, thereby considerably prolonging the IR accelerated lifetime.

The annealing atmosphere preferably has an oxygen partial pressure of at least $10^{-6}$ atm., and especially $10^{-6}$ to $10^{-8}$ atm. An oxygen partial pressure below the range may make it difficult to oxidize the insulator layer or dielectric layer again whereas an oxygen partial pressure above the range tends to oxidize the internal conductor.

The holding temperature during the annealing step is preferably up to 1,100° C., and especially 1,000 to 1,100° C. A holding temperature below the range tends to oxidize the insulator layer or dielectric layer to an insufficient extent, resulting in a short lifetime. A holding temperature above the range not only tends to oxidize the electrode layer to reduce the current capacity, but also tends to cause the electrode layer to react with the insulating or dielectric matrix, resulting in a short lifetime.

It is noted that the annealing step may consist solely of heating and cooling steps. In this case, the temperature holding time is zero and the holding temperature is equal to the maximum temperature. The temperature holding time is preferably 0 to 20 hours, and especially 2 to 10 hours. The gas for the atmosphere is preferably humidified $H_2$ gas or the like.

In each of the aforementioned binder removal, firing and annealing steps, $N_2$, $H_2$ or a mixture gas thereof is humidified using a wetter, for example. Water in the wetter is preferably at a temperature of about 5 to 75° C.

The binder removal, firing and annealing steps may be carried out either continuously or separately.

Preferably, the process of carrying out these steps continuously involves, after the binder removal step, changing the atmosphere without cooling, heating to the holding temperature for firing, thereby carrying out the firing step, then cooling, changing the atmosphere when the holding temperature for annealing is reached, and carrying out the annealing step.

In the process of carrying out these steps separately, the binder removal step is carried out by heating to a predetermined holding temperature, holding thereat for a predetermined time, and cooling to room temperature. The atmosphere for binder removal is the same as used in the continuous process. Further, the annealing step is carried out by heating to a predetermined holding temperature, holding thereat for a predetermined time, and cooling to room temperature. The annealing atmosphere is the same as used in the continuous process. In an alternative embodiment, the binder removal step and the firing step are carried out continuously, and only the annealing step is carried out separately. In a further alternative embodiment, only the binder removal step is carried out separately, and the firing step and the annealing step are carried out continuously.

The composite substrate is obtained in this way.

From the composite substrate of the invention, a thin-film EL device can be fabricated by forming thereon functional films including a light emitting layer, another insulating layer, and another electrode layer. In particular, a thin-film EL device having improved performance can be obtained using a dielectric material in the insulating layer of the composite substrate according to the invention. Since the composite substrate of the invention is a sintered material, it is also suited for use in a thin-film EL device which is fabricated by carrying out heat treatment subsequent to the formation of a functional film of light emitting layer.

To fabricate a thin-film EL device using the composite substrate of the invention, a light emitting layer, another insulating layer or dielectric layer, and another electrode layer may be formed on the insulating layer or dielectric layer in the described order.

Exemplary materials for the light emitting layer include the materials described in monthly magazine Display, April 1998, Tanaka, "Technical Trend of Recent Displays," pp. 1–10. Illustrative are ZnS and Mn/CdSSe as the red light emitting material, ZnS:TbOF and ZnS:Tb as the green light emitting material, and SrS:Ce, (SrS:Ce/ZnS)n, $Ca_2Ga_2S_4$:Ce, and $Sr_2Ga_2S_4$:Ce as the blue light emitting material.

SrS:Ce/ZnS:Mn or the like is known as the material capable of emitting white light.

Among others, better results are obtained when the invention is applied to the EL device having a blue light emitting layer of SrS:Ce studied in International Display Workshop (IDW), '97, X. Wu, "Multicolor Thin-Film Ceramic Hybrid EL Displays," pp. 593–596.

The thickness of the light emitting layer is not critical. However, too thick a layer requires an increased drive voltage whereas too thin a layer results in a low emission efficiency. Illustratively, the light emitting layer is preferably about 100 to 1,000 nm thick, and preferably about 150 to 500 nm thick, although the thickness varies depending on the identity of the fluorescent material.

In forming the light emitting layer, any vapor phase deposition technique may be used. The preferred vapor phase deposition techniques include physical vapor deposition such as sputtering or evaporation, and chemical vapor deposition (CVD). Of these, the chemical vapor deposition (CVD) technique is preferred.

Also, as described in the above-referred IDW, when a light emitting layer of SrS:Ce is formed in a $H_2S$ atmosphere by an electron beam evaporation technique, the resulting light emitting layer can be of high purity.

Following the formation of the light emitting layer, heat treatment is preferably carried out. Heat treatment may be carried out after an electrode layer, an insulating layer, and a light emitting layer are sequentially deposited in order from the substrate side. Alternatively, heat treatment (cap annealing) may be carried out after an electrode layer, an insulating layer, a light emitting layer and an insulating layer are sequentially deposited in order from the substrate side or after an electrode layer is further formed thereon. Often, cap annealing is preferred. The temperature of heat treatment is preferably about 600 to the substrate sintering temperature, more preferably about 600 to 1300° C., especially about 800 to 1200° C., and the time is about 10 to 600 minutes, especially about 30 to 180 minutes. The atmosphere during the annealing treatment may be $N_2$, Ar, He, or $N_2$ in admixture with up to 0.1% of $O_2$.

The insulating layer formed on the light emitting layer preferably has a resistivity of at least about $10^8$ Ω•cm, especially about $10^{10}$ to $10^{18}$ Ω•cm. A material having a relatively high permittivity as well is preferred. Its permittivity $\epsilon$ is preferably about 3 to 1,000.

The materials of which the insulating layer is made include, for example, silicon oxide ($SiO_2$), silicon nitride (SiN), tantalum oxide ($Ta_2O_5$), strontium titanate ($SrTiO_3$), yttrium oxide ($Y_2O_3$), barium titanate ($BaTiO_3$), lead titanate ($PbTiO_3$), zirconia ($ZrO_2$), silicon oxynitride (SiON), alumina ($Al_2O_3$), lead niobate ($PbNb_2O_6$), etc.

The technique of forming the insulating layer from these materials is the same as described for the light emitting layer. The insulating layer preferably has a thickness of about 50 to 1,000 nm, especially about 100 to 500 nm.

The EL device of the invention is not limited to the single light emitting layer construction. For example, a plurality of light emitting layers may be stacked in the thickness direction, or a plurality of light emitting layers (pixels) of different type are combined in a planar arrangement so as to define a matrix pattern.

Since the thin-film EL device of the invention uses the substrate material resulting from firing, even a light emitting layer capable of emitting blue light at a high luminance is readily available. Additionally, since the surface of the insulating layer on which the light emitting layer lies is smooth and flat, a color display featuring high performance and fine definition can be constructed. The manufacturing process is relatively easy and the manufacturing cost can be kept low. Because of its efficient emission of blue light at a high luminance, the device can be combined as a white light emitting device with a color filter.

As the color filter film, any of color filters used in liquid crystal displays or the like may be employed. The characteristics of a color filter are adjusted to match with the light emitted by the EL device, thereby optimizing extraction efficiency and color purity.

It is also preferred to use a color filter capable of cutting external light of short wavelength which is otherwise absorbed by the EL device materials and fluorescence conversion layer, because the light resistance and display contrast of the device are improved.

An optical thin film such as a dielectric multilayer film may be used instead of the color filter.

The fluorescence conversion filter film is to convert the color of light emission by absorbing electroluminescence and allowing the phosphor in the film to emit light. It is formed from three components: a binder, a fluorescent material, and a light absorbing material.

The fluorescent material used may basically have a high fluorescent quantum yield and desirably exhibits strong absorption in the electroluminescent wavelength region. In practice, laser dyes are appropriate. Use may be made of rhodamine compounds, perylene compounds, cyanine compounds, phthalocyanine compounds (including subphthalocyanines), naphthalimide compounds, fused ring hydrocarbon compounds, fused heterocyclic compounds, styryl compounds, and coumarin compounds.

The binder is selected from materials which do not cause extinction of fluorescence, preferably those materials which can be finely patterned by photolithography or printing technique.

The light absorbing material is used when the light absorption of the fluorescent material is short and may be omitted if unnecessary. The light absorbing material may also be selected from materials which do not cause extinction of fluorescence of the fluorescent material.

The thin-film EL device of the invention is generally operated by pulse or AC drive. The applied voltage is generally about 50 to 300 volts.

Although the thin-film EL device has been described as a representative application of the composite substrate, the application of the composite substrate of the invention is not limited thereto. It is applicable to a variety of electronic materials, for example, thin-film/thick-film hybrid high-frequency coil elements.

EXAMPLE

Examples are given below. The EL structure used in the Examples is constructed such that a light emitting layer, an upper insulating layer and an upper electrode were successively deposited on the surface of an insulating layer of a composite substrate by thin-film techniques.

Example 1

A paste, which was prepared by mixing Ag-Ti powder with a binder (ethyl cellulose) and a solvent (terpineol), was printed on a substrate of 99.5% $Al_2O_3$ in a stripe pattern including stripes of 1.5 mm wide and gaps of 1.5 mm, and dried at 110° C. for several minutes. A dielectric paste was prepared by mixing $Pb(Mg_{1/3}Nb_{2/3})O_3$-$PbTiO_3$ (PMN-PT) powder raw material having a mean particle size of 1 $\mu$m with a binder (acrylic resin) and a solvent (methylene chloride+acetone).

The dielectric paste was printed on the substrate having the electrode pattern printed thereon and dried, and the printing and drying steps were repeated ten times. The resulting green dielectric layer had a thickness of about 80 μm. Then, a PET film coated with silicone was placed on the dielectric precursor, which was subjected to heat compression for 10 minutes under a pressure of 500 ton/$m^2$ while heating at 120° C. Next, the structure was fired in air at 900° C. for 30 minutes. The thick-film dielectric layer as fired had a thickness of 55 μm.

A sol-gel solution for forming a thin-film insulator layer was prepared as follows. First, lead acetate was dehydrated in a vacuum atmosphere at 60° C. for more than 12 hours. The dehydrated lead acetate was mixed with 1,3-propane diol at 120° C. for 2 hours for dissolution.

Separately, a 1-propanol solution of zirconium tetra-n-propoxide was mixed with acetylacetone at 120° C. for 30 minutes. To the mixed solution, titanium diisopropoxide bisacetylacetonato and 1,3-propane diol were added, followed by mixing at 120° C. for a further 2 hours. The resulting solution was mixed with the above lead acetate solution at 80° C. for 5 hours. The thus prepared solution was adjusted to an appropriate concentration by adding 1-propanol.

The sol-gel solution thus prepared was passed through a 0.2-micron filter to remove the precipitate, before it was spin coated onto the thick-film dielectric layer of the composite substrate at 1500 rpm for one minute. The composite substrate with the spin-coated solution was placed on a hot plate at 120° C. for 3 minutes for drying the solution. Thereafter, the composite substrate was placed in an electric oven held at 600° C. where it was fired for 15 minutes. The spin coating/drying/firing procedure was repeated three times.

A composite substrate was obtained in this way.

Example 2

In Example 1, the drying following the coating of the sol-gel solution was carried out at 350° C. Otherwise as in Example 1, a composite substrate was obtained.

Example 3

In Example 1, the drying following the coating of the sol-gel solution was carried out at 420° C. Otherwise as in Example 1, a composite substrate was obtained.

Example 4

In preparing the acetic acid solution in Example 3, dehydrated lanthanum oxide was added to 1,3-propane diol along with the lead acetate. The solution was adjusted so as to provide a Pb/La/Zr/Ti ratio of 1.14/0.06/0.53/0.47. This solution was adjusted to a concentration that contained 0.8 mol of Pb+La in 1000 ml of the solution. Otherwise as in Example 1, a composite substrate was obtained.

In each of Examples, the surface roughness of the dielectric layer was measured by means of a Talistep while moving a probe at a speed of 0.1 mm/sec over 0.8 mm. Also, to measure the electrical properties of the dielectric layer, an upper electrode was formed thereon. The upper electrode was formed by printing the above electrode paste to a stripe pattern having a width of 1.5 mm and a gap of 1.5 mm so as to extend perpendicular to the underlying electrode pattern on the substrate, drying and firing at 850° C. for 15 minutes.

Dielectric properties were measured at a frequency of 1 kHz using an LCR meter. Insulation resistance was determined by measuring a current flow after applying a voltage of 25V for 15 seconds and holding for one minute. Breakdown voltage was the voltage value at which a current of at least 0.1 mA flowed when the voltage applied across the sample was increased at a rate of 100 V/sec. Measurement of surface roughness and electrical properties was made at three distinct positions on a single sample and an average thereof was reported as a measurement.

On the composite substrate not having an upper electrode, which was heated at 250° C., a ZnS phosphor thin film was deposited to a thickness of 0.7 μm by a sputtering technique using a Mn-doped ZnS target. This was heat treated in vacuum at 600° C. for 10 minutes. Thereafter, a $Si_3N_4$ thin film as the second insulating layer and an ITO thin film as the second electrode were successively formed by a sputtering technique, completing an EL device. Light emission was measured by extending electrodes from the print fired electrode and ITO transparent electrode in the resulting device structure and applying an electric field at a frequency of 1 kHz and a pulse width of 50 μs.

Table 1 shows the electrical properties of the dielectric layers on the above-prepared composite substrates as well as the luminescent properties of the EL devices fabricated above using the composite substrates. For comparison purposes, the properties of a composite substrate without a thin-film dielectric layer are also reported.

TABLE 1

| | Sol-gel solution | | Surface roughness (unit: μm) | | | | |
|---|---|---|---|---|---|---|---|
| | Composition | Drying temperature | Ra | RMS | Rmax | Rz | Remarks |
| Com. 1 | non | | 0.187 | 0.240 | 2.287 | 1.671 | |
| Ex. 1 | $Pb(Zr,Ti)O_3$ | 120° C. | — | — | — | — | many cracks in thin-film dielectric layer |
| Ex. 2 | $Pb(Zr,Ti)O_3$ | 350° C. | — | — | — | — | many cracks in thin-film dielectric layer |
| Ex. 3 | $Pb(Zr,Ti)O_3$ | 420° C. | 0.065 | 0.086 | 1.190 | 0.562 | no cracks |
| Ex. 4 | $(Pb,La)(Zr,Ti)O_3$ | 420° C. | 0.070 | 0.101 | 1.220 | 0.595 | no cracks |

| | Relative permittivity none | tan δ (%) | Dielectric strength (V/μm) | Emission start voltage | Emission luminance at 210 V (cd/$m^2$) |
|---|---|---|---|---|---|

TABLE 1-continued

| | | | | | |
|---|---|---|---|---|---|
| Com. 1 | 19300 | 2.0 | 14 | 150 | 1050 |
| Ex. 1 | — | — | — | — | — |
| Ex. 2 | — | — | — | — | — |
| Ex. 3 | 12500 | 2.4 | 13 | 165 | 1350 |
| Ex. 4 | 10300 | 3.8 | 11 | 170 | 1300 |

Com.: Comparative example
Ex.: example

Benefits of the Invention

There has been described a method for preparing a composite substrate of substrate/electrode/dielectric layer structure having a thick-film dielectric layer with a smooth surface using a sol-gel solution of high concentration capable of forming a film to a substantial thickness without generating cracks. The composite substrate, the method of preparing the same, and an EL device using the same are provided.

What is claimed is:

1. A method for preparing a composite substrate, for an electroluminscent device having improved luminescence comprising in order: an electrically insulating substrate, an electrode and an insulator layer formed on the substrate by a thick film technique, wherein a thin-film insulator layer to provide a smooth surface on said insulator layer is formed by applying to said insulator layer a sol-gel solution obtained by dissolving at least one metal compound in a diol represented by $OH(CH_2)_nOH$ as a solvent, followed by drying at a temperature of at least 400° C. and firing.

2. The method according to claim 1, wherein said solvent is propane diol $OH(CH_2)_3OH$.

3. The method according to claim 1, wherein at least one of said at least one metal compound is an acetylacetonato complex $M(CH_3COCHCOCH_3)_n$ wherein M is a metal element, or an acetylacetonato product obtained by reacting a metal compound with acetylacetone $CH_3COCH_2COCH_3$.

4. The method according to claim 1, wherein said metal compound is $(Pb_xLa_{1-x})(Zr_y,Ti_{1-y})O_3$, wherein x and y each are from 0 to 1.

5. The method according to claim 3, wherein metal element M is Ba, Ti, Zr or Mg.

6. The method according to claim 1, wherein said metal compound is present in an amount of 0.1 to 5.0 mol per 1000 ml of the solvent.

7. The method according to claim 1, wherein the insulator layer comprises a dielectric material.

8. The method according to claim 7, wherein said dielectric material comprises barium titanate as a main component and silicon oxide and at least one of magnesium oxide, manganese oxide, barium oxide, yttrium oxide or calcium oxide as auxiliary components.

9. The method according to claim 8, wherein said dielectric material comprises barium oxide and calcium oxide as auxiliary components, wherein a ratio of $(BaO+CaO)/SiO_2$, is between 0.9 and 1.1.

10. The method according to claim 8, where said dielectric material comprises up to 1 mol of yttrium oxide per 100 mols of barium titanate.

11. The method according to claim 9, wherein said BaO, CaO and $SiO_2$ are incorporated in a form of $(Ba_xCa_{1-x}O)_y.SiO_2$, wherein x and y satisfy $0.3 \leqq x \leqq 0.7$ and $0.95 \leqq y \leqq 1.05$.

12. The method according to claim 1, wherein the insulating substrate comprises ceramic or glass.

13. The method according to claim 1, wherein the insulating substrate is selected from the group consisting of alumina ($Al_2O_3$), quartz ($SiO_2$), magnesia (MgO), forsterite ($2MgO.SiO_2$), steatite ($MgO.SiO_2$), mullite ($3Al_2O_3.2SiO_2$), beryllia (BeO), zirconia (ZrO2), aluminum nitride (AlN), silicon nitride (SiN), silicon carbide, and (SiC+BeO) barium-, lead- or strontium Perovskite compounds.

14. The method according to claim 13, wherein said ceramic is alumina, beryllia, aluminum nitride or silicon carbide.

15. The method according to claim 1, wherein said firing is conducted at a temperature of at least 800° C.

16. The method according to claim 15, wherein said firing is conducted at a temperature of about 1,200° C. to 1,400° C.

17. A method for preparing a composite substrate for an electroluminescent device having improved luminescence comprising in order: an electrically insulating substrate, an electrode and an insulator layer formed on the substrate by a thick film technique, wherein a thin-film insulator layer which at least partly covers asperities is formed by applying to said insulator layer a sol-gel solution obtained by dissolving at least one metal compound in a diol represented by $OH(CH_2)_nOH$ as a solvent, followed by drying at a temperature of at least 400° C. and firing.

18. A method for preparing a composite substrate for an electroluminescent device having improved luminescence comprising in order: an electrically insulating substrate, an electrode and an insulator layer formed on the substrate by a thick film technique, wherein a thin-film insulator layer which at least partly fills asperities is formed by applying to said insulator layer a sol-gel solution obtained by dissolving at least one metal compound in a diol represented by $OH(CH_2)_nOH$ as a solvent, followed by drying at a temperature of at least 400° C. and firing.

* * * * *